US006659850B2

(12) United States Patent
Korovin et al.

(10) Patent No.: US 6,659,850 B2
(45) Date of Patent: Dec. 9, 2003

(54) WORK PIECE CARRIER WITH ADJUSTABLE PRESSURE ZONES AND BARRIERS AND A METHOD OF PLANARIZING A WORK PIECE

(75) Inventors: Nikolay N. Korovin, Phoenix, AZ (US); Stephen C. Schultz, Gilbert, AZ (US); John D. Herb, Phoenix, AZ (US); James L. Farmer, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 10/120,600

(22) Filed: Apr. 11, 2002

(65) Prior Publication Data

US 2002/0111122 A1 Aug. 15, 2002

Related U.S. Application Data

(63) Continuation-in-part of application No. 09/540,476, filed on Mar. 31, 2000, now Pat. No. 6,390,905.

(51) Int. Cl.[7] ..... B24B 29/00; B24B 5/00; B24B 1/00

(52) U.S. Cl. ..... 451/286; 451/288; 451/398; 451/41

(58) Field of Search ..... 451/285, 286, 451/287, 288, 289, 290, 398, 41

(56) References Cited

U.S. PATENT DOCUMENTS

| | | | | |
|---|---|---|---|---|
| 5,205,082 A | | 4/1993 | Shendon et al. | |
| 5,230,184 A | | 7/1993 | Bukhman | |
| 5,584,746 A | | 12/1996 | Tanaka et al. | |
| 5,584,751 A | | 12/1996 | Kobayashi et al. | |
| 5,605,488 A | | 2/1997 | Ohashi et al. | |
| 5,624,299 A | | 4/1997 | Shendon | |
| 5,660,517 A | | 8/1997 | Thompson et al. | |
| 5,681,215 A | | 10/1997 | Sherwood et al. | |
| 5,738,574 A | | 4/1998 | Tolles et al. | |
| 5,762,539 A | | 6/1998 | Nakashiba et al. | |
| 5,762,544 A | | 6/1998 | Zuniga et al. | |
| 5,762,546 A | | 6/1998 | James et al. | |
| 5,795,215 A | | 8/1998 | Guthrie et al. | |
| 5,820,448 A | | 10/1998 | Shamouilian et al. | |
| 5,941,758 A | | 8/1999 | Mack | |
| 5,964,653 A | | 10/1999 | Perlov et al. | |
| 6,361,419 B1 | * | 3/2002 | Zuniga et al. | 451/287 |
| 6,390,905 B1 | * | 5/2002 | Korovin et al. | 451/286 |

FOREIGN PATENT DOCUMENTS

| | | |
|---|---|---|
| DE | 199 41 903 | 3/2001 |
| EP | 0 451 471 | 10/1991 |
| EP | 0 847 835 | 6/1998 |
| EP | 0 922 531 | 6/1999 |
| WO | WO 96/36459 | 11/1996 |
| WO | WO 00/51782 | 9/2000 |

* cited by examiner

*Primary Examiner*—Dung Van Nguyen
(74) *Attorney, Agent, or Firm*—Ingrassia Fisher & Lorenz

(57) ABSTRACT

An apparatus for planarizing a work piece includes an easily assembled work carrier. The carrier includes a carrier insert having a work piece bladder clamped to a carrier backing plate with a plurality of clamps to form a plurality of web plenums. The outer edge of the bladder is supported by a rib that is coupled to a carrier plenum. By adjusting the pressure in the carrier plenum, the pressure exerted on the edge of a work piece during a planarization operation can be adjusted. The carrier also includes a floating wear ring that surrounds the work piece bladder and a work piece mounted on that bladder. By adjusting the force exerted by the wear ring on a polishing pad, independently of the pressure exerted by the rib at the edge of the bladder, the material removal rate near the edge of the work piece can be controlled.

21 Claims, 13 Drawing Sheets

WORK PIECE CARRIER WITH ADJUSTABLE PRESSURE ZONES AND BARRIERS AND A METHOD OF PLANARIZING A WORK PIECE

RELATED APPLICATIONS

This application is a continuation in part of application Ser. No. 09/540,476 filed Mar. 31, 2000, now U.S. Pat. No. 6,390,905.

TECHNICAL FIELD

The present invention relates generally to the art of planarizing a work piece against an abrasive surface. For example, the present invention may be used to planarizing a wafer, or thin films deposited thereon, in an improved wafer carrier with adjustable pressure zones and adjustable pressure barriers against a polishing pad in a chemical mechanical planarization (CMP) tool.

BACKGROUND OF THE INVENTION

The manufacture of many types of work pieces requires the substantial planarization of at least one surface of the work piece. Examples of such work pieces that require a planar surface include semiconductor wafers, optical blanks, memory disks, and the like. Without loss of generality, but for ease of description and understanding, the following description of the invention will focus on applications to only one specific type of work piece, namely a semiconductor wafer. The invention, however, is not to be interpreted as being applicable only to semiconductor wafers.

One commonly used technique for planarizing the surface of a work piece is the chemical mechanical planarization (CMP) process. In the CMP process a work piece, held by a work piece carrier head, is pressed against a polishing pad in the presence of a polishing slurry, and relative motion (rotational, orbital, linear, or a combination of these) between the work piece and the polishing pad is initiated. The mechanical abrasion of the work piece surface combined with the chemical interaction of the slurry with the material on the work piece surface ideally produces a planar surface.

The construction of the carrier head and the relative motion between the polishing pad and the carrier head have been extensively engineered in an attempt to achieve a uniform removal of material across the surface of the work piece and hence to achieve the desired planar surface. For example, the carrier head generally includes a flexible membrane that contacts the back or unpolished surface of the work piece and accommodates variations in that surface. One or more pressure chambers (separated by pressure barriers) may be provided behind the membrane so that different pressures can be applied to various locations on the back surface of the work piece to cause uniform polishing across the front surface of the work piece. The carrier head also generally includes a wear ring (sometimes referred to as a "retaining ring" or "edge ring" but hereinafter referred to without limitation as a "wear ring") that surrounds the membrane and the work piece and that pre-stresses or pre-compresses the polishing pad to protect the leading edge of the work piece.

However, Applicants have discovered that the pressure distribution across the back surface of the wafer for conventional carriers is not sufficiently controllable. This is due to the lack of control of the pressure caused by the barriers on the back surface of the wafer. The barriers are important in controlling the pressure on the back surface of the wafer between internal chambers. Therefore, the ability to control the applied pressure across the entire back surface of the wafer is limited, thereby restricting the ability to compensate for anticipated removal problems.

An additional problem that limits the degree of planarity that can be achieved on the work piece surface is the discontinuity in pressure applied to the work piece and to the polishing pad at the gap between the work piece edge and the edge of the wear ring.

What is needed is a system for controlling the application of multiple pressure zones and the pressure from the barriers between zones across the entire back surface of a wafer and at the edge of the work piece during planarization.

What is also needed is a work piece carrier head that can be easily assembled that will allow for the control of the pressure in multiple pressure zones and to multiple pressure adjustable barriers.

BRIEF DESCRIPTION OF THE DRAWINGS

The present invention will hereinafter be described in conjunction with the appended drawing figures, wherein like numerals denote like elements, and in which.

DETAILED DESCRIPTION OF EXEMPLARY EMBODIMENTS

In accordance with an embodiment of the present invention, a work piece carrier is disclosed for planarizing a surface of a work piece. The carrier includes a central disk shaped plenum, a plurality of concentric ring shaped plenums surrounding the central plenum and a plurality of concentric barriers between neighboring plenums. The pressure distribution on the back surface of the work piece may be controlled by adjusting the pressure in the plenums and the pressure exerted on the barriers. The carrier is configured in a manner to be easily assembled. In accordance with another embodiment of the invention, a carrier is disclosed that includes a wear ring shaped to accommodate a clamping mechanism of a carrier web diaphragm. In yet another embodiment of the invention, a method is disclosed for utilizing the work piece carrier to control the planarization of the surface of a work piece, especially at the outer edge of the surface, so that planarization may be realized across the entire work piece surface. These and other aspects of the present invention are described in full detail in the following description. CMP tools that may be used to practice the present invention are well known in the art and will not be discussed in detail to avoid obscuring the nature of the present invention.

A work piece carrier in a CMP tool must retain a work piece such as a semiconductor wafer and assist in the distribution of a pressing force on the back of the wafer while the front of the wafer is planarized against an abrasive surface. The abrasive surface typically comprises a polishing pad wetted by chemically active slurry with suspended abrasive particles. The preferred polishing pad and slurry are highly dependant on the particular process and work piece being planarized. Those of skill in the art will be familiar with appropriate polishing pads and slurries for a particular application. Conventional CMP polishing pads and slurries for typical applications are made commercially available, for example, by Rodel Inc. from Phoenix, Ariz.

Figure 1:
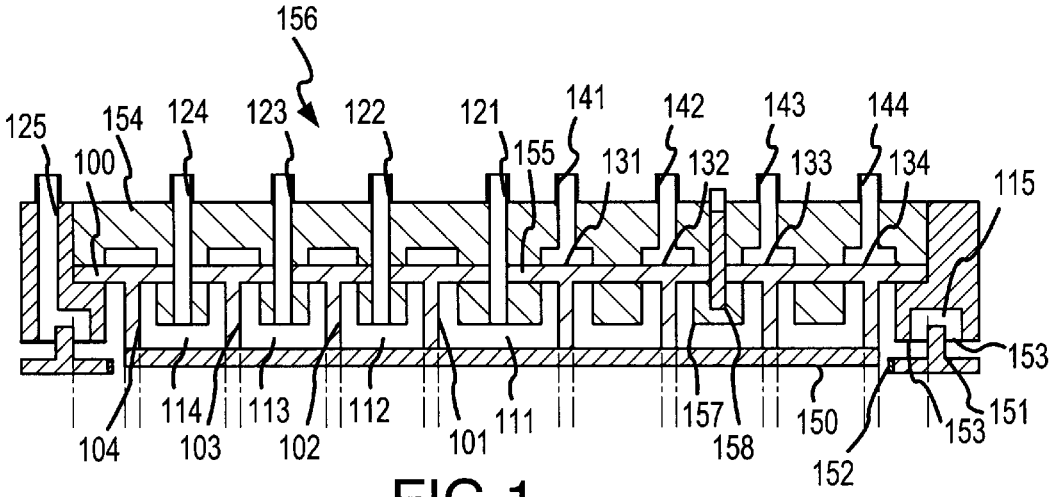
FIG. 1 illustrates, in a simplified cross section view, a carrier having adjustable concentric ribs defining adjustable pressure zones therebetween.
Figure 11:
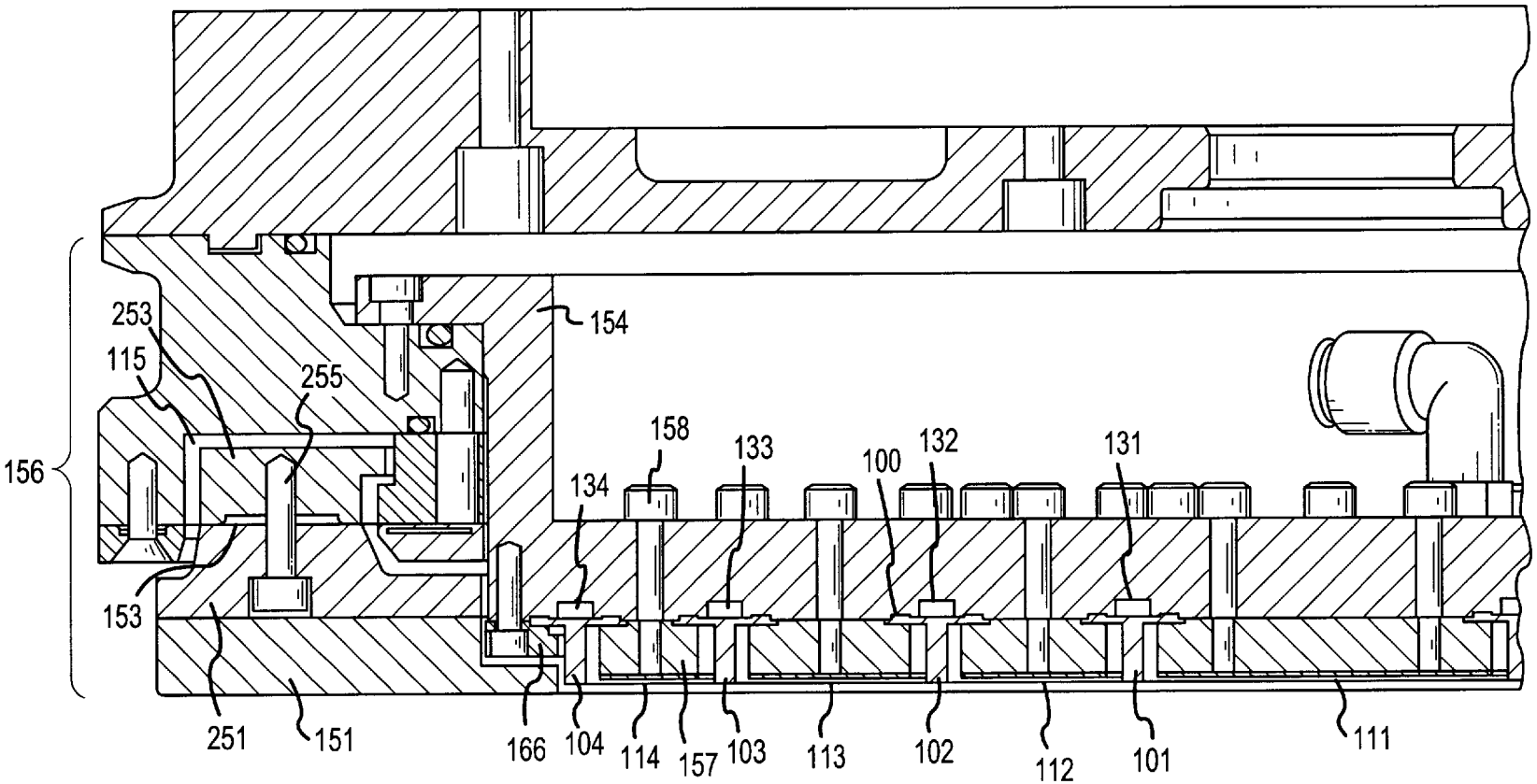
FIG. 11 illustrates, in a cross section view, a more detailed drawing of a carrier similar to the carrier in FIG. 1.

Referring to FIG. 1 and FIG. 11, an exemplary embodiment of the present invention will be discussed in detail. A work piece carrier 156 for a CMP apparatus, schematically illustrated in cross section in FIG. 1, includes a rigid cylindrical carrier housing 154 providing a rigid superstructure. For illustrative purposes only, but without limitation, the work piece carrier described herein will be a carrier adapted for chemical mechanical planarization of a semiconductor wafer. That is, the work piece for which the carrier is configured is a semiconductor wafer. Carrier housing 154 may be made of stainless steal, for example, to give the carrier housing the necessary rigidity and resistance to corrosion needed in a CMP environment. The top major surface of cylindrical carrier housing 154 may be adapted to be connected to almost any conventional CMP tool. Most conventional CMP tools have a movable shaft used for transporting carrier 156 and a wafer 150 confined thereby. The movable shaft typically allows carrier 156 to move both vertically and horizontally between a wafer loading and/or unloading station and a position in proximity and parallel to an abrasive surface in a CMP apparatus.

The bottom major surface of carrier housing 154 has a plurality of concentric ring shaped recesses (hereinafter called carrier plenums) 131–134. For maximum control of the pressure distribution on the back surface of a wafer, at least one carrier fluid communication path 141–144 is in fluid communication with each carrier plenum 131–134. Carrier fluid communication paths 141–144 are routed through carrier housing 154 to an apparatus (not illustrated) for delivering an independently pressurized fluid to each carrier plenum 131–134, the purpose for which will be explained below.

A web diaphragm 100 is coupled to carrier housing 154 across the carrier housing's bottom major surface thereby sealing the carrier plenums 131–134. Web diaphragm 100 may be coupled to the carrier housing 154 with adhesives, screws or other known techniques. However, web diaphragm 100 is preferably kept in place by tightening a plurality of bolts 158 that pull clamp rings 157 against carrier housing 154 thereby trapping web diaphragm 100 in place between carrier housing 154 and clamp rings 157.

A plurality of concentric barriers 101–104 extends orthogonally from a major surface of the web diaphragm 100 opposite the carrier plenums 131–134. The barriers 101–104 may take the form of o-rings, bellows or other known configurations capable of separating neighboring pressure zones within which different pressures can be established. In accordance with a preferred embodiment of the invention, each barrier is a short piece of material hereafter referred to as a "rib". The head of each rib 101–104 is connected to web diaphragm 100 while the foot of each rib is used to support either a wafer 150 or a wafer diaphragm 300 (wafer diaphragm 300 is not illustrated in FIGS. 1 and 11, but is discussed below with reference to FIGS. 3 and 12). Ribs 101–104 are made as short as possible, preferably less than 15 mm in length and about 2.5 mm in width, to maximize the load capabilities and minimize deflections during the planarization process. While web diaphragm 100 and ribs 101–104 may be manufactured as a single piece of elastic material, they are preferably separate pieces held together against carrier housing 154 by clamping rings 157. Web diaphragm 100 and ribs 101–104 are preferably formed of an elastic material such as EPDM.

Figure 2:
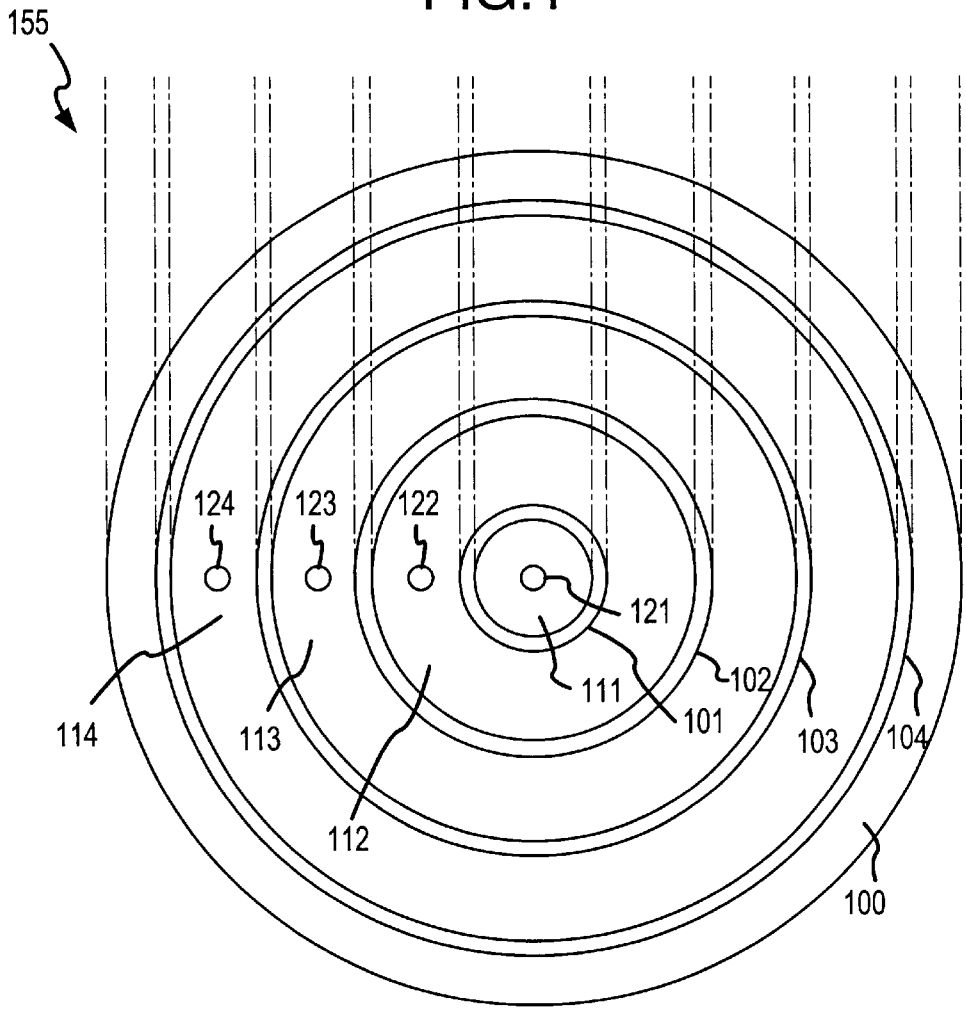
FIG. 2 illustrates, in a bottom view, a web diaphragm with orthogonally attached concentric ribs defining a central disk shaped web plenum surrounded by concentric ring shaped web plenums.

The number of concentric barriers or ribs used with web diaphragm 100 will directly correspond to the number of independently controllable pressure zones that are to be created for a particular application. For example, FIG. 2 illustrates, in a bottom view of web diaphragm 100, four concentric ribs 101–104 used to create a central disk shaped web plenum 111 surrounded by three concentric ring shaped web plenums 112–114. Central disk shaped web plenum 111 is defined by the inner diameter of innermost rib 101, while the surrounding web plenums 112–114 are defined by the outer diameter and inner diameter of adjacent ones of ribs 101–104. The spacing between ribs 101–104 (and carrier plenums 131–134) may be adjusted to control the width and position of web plenums 111–114. For optimum control of the pressure distribution on the back surface of the wafer, at least one independently controllable web fluid communication path 121–124 is in fluid communication with each web plenum 111–114. Web fluid communication paths 121–124 may be routed through the carrier housing and out the top of the carrier.

With reference again to FIGS. 1 and 11, carrier 156 also includes a floating wear ring 151 that is configured to surround wafer 150 and to confine the wafer beneath carrier housing 154 during a CMP operation. The wear ring compresses the polishing pad ahead of the wafer and thus preconditions the polishing pad. To achieve optimum control of the planarization, the gap between the inner diameter of the wear ring and the wafer is minimized. For example, for a wafer having a diameter of 200 mm, the inner diameter of wear ring 151 can be 202 mm or less so that the gap between the wear ring and the wafer is 2 mm or less. The floating wear ring may be attached to the carrier housing with a wear ring diaphragm held taut over a ring shaped recess in the periphery of the carrier housing. A wear ring plenum 115 is thus created between the ring shaped recess in the carrier housing and the wear ring diaphragm. A wear ring fluid communication path routed through the carrier housing can communicate a desired pressure to the wear ring plenum and thus to the wear ring. As illustrated in FIG. 11, wear ring 151 is joined to a wear ring carrier block 251. The wear ring and carrier block can be joined, for example, by an adhesive, allowing the wear ring to be changed periodically in response to excessive wear. Wear ring carrier block 251, in turn, is coupled to a clamp 253, for example, with a threaded fastener 255. The wear ring carrier block is clamped against a wear ring diaphragm 153 that, together with carrier housing 154, forms wear ring plenum 115. By pressurizing plenum 115, the vertical position of wear ring 151 can be controlled. The wear ring preloads and shapes a portion of the polishing pad prior to the wafer moving over that portion of the polishing pad. By controlling the vertical position of the wear ring, the pressure exerted by the wear ring on the polishing pad and thus the amount of preloading and shaping can be controlled. As will be explained below, controlling the pressure exerted by the wear ring on the polishing pad can be important in controlling the resulting planarization of the wafer and especially of the edge portion of the surface of the wafer.

Referring again to FIG. 1, an example of one possible method for routing a pressurized fluid to carrier plenums 131–134, web plenums 111–114 and wear ring plenum 115 is illustrated for a typical CMP tool design. A compressor (not illustrated) may be used to generate a pressurized fluid that may be fed through a manifold to one or more regulators (not illustrated). The pressure generated by the compressor should be higher than the pressure actually needed by any of the plenums. One independently controllable regulator is preferably used for each carrier plenum 131–134, web plenum 111–114 and wear ring plenum 115 on the carrier 156. The regulators are in fluid communication with corresponding ones of carrier fluid communication paths 141–144, web fluid communication paths 121–124, and wear ring fluid communication path 125. The fluid communication paths may be routed through a rotary union on a hollow shaft, commonly found in CMP tools, connected to the carrier 156. The fluid communication paths may then be routed through the hollow shaft and carrier 156 to their respective plenums. The present invention may be practiced using a variety of compressors, manifolds, regulators, fluid communication paths, rotary unions and hollow shafts, all of which are well known in the art.

Central disk shaped web plenum 111 and surrounding ring shaped web plenums 112–114 may be individually pressurized to produce a plurality of concentric constant pressure zones on the back surface of a wafer 150. Additionally, as explained more fully below, wear ring plenum 115 may also be independently pressurized to control the vertical position of wear ring 151 and the pressure exerted on the polishing pad by the wear ring. The volume of web plenums 111–114 may be made smaller, and thus easier and quicker to pressurize, by increasing the size of the clamp rings 157. The particular pressure chosen for each pressure zone depends on the surface geometry and materials comprising the incoming wafers in combination with the other process parameters of the CMP apparatus. For planarizing the dielectric used in shallow trench isolation (STI) or for planarizing copper deposited on a semiconductor wafer, for example, pressures from 0.1 to 10 psi, and preferably 0.5 to 6 psi may be used with a conventional CMP apparatus.

A work piece carrier such as carrier 156 may be provided with additional controllable pressure zones, each having a smaller average width, to thereby give the carrier finer control of the pressure distribution on the backside of a work piece. To reduce complexity and cost of the CMP apparatus, however, the preferred carrier therefore uses the minimum number of web plenums necessary for a given work piece surface geometry.

Additional structural support may be used to increase the strength and to minimize the deflection of ribs 101–104. Additional structural support for the ribs may be added with external or internal hoops being attached on the side of the ribs, external or internal structural threads attached to the ribs, or by using materials for the ribs that has a higher modulus of elasticity.

In accordance with one embodiment of the invention, an individually controllable pressing force may be placed on the head of each rib 101–104 by pressurizing the corresponding carrier plenum 131–134 associated with each of the ribs. The down forces generated by pressurizing carrier plenums 131–134 is transmitted through ribs 101–104 to the rib feet. The force on each rib presses the foot of the rib against either a wafer 150 or a wafer diaphragm 300 (discussed below with reference to FIG. 3 and FIG. 12) to create a superior seal for each web plenum 111–114 and to smooth out pressure distributions across the surface of the wafer. By individually adjusting the rib pressure, discontinuities in pressure exerted against the wafer at the boundary between adjacent web plenums can be avoided. The pressure on each rib 101–104 is advantageously made equal to or greater than the pressure in the neighboring web plenums 111–114 to help prevent fluid from leaking between the neighboring web plenums 111–114. The pressurized fluid for the carrier plenums 131–134, web plenums 111–114 and wear ring plenum 115 may be a liquid or gas, but preferably is filtered air.

The rib feet may be enhanced to prevent pressurized fluid from leaking between neighboring web plenums 111–114. The shape of the rib feet will affect how well the feet seal, how well pressure is transmitted through ribs 101–104 to wafer 150, and how well the feet "gimbal" on wafer 150. Rib foot designs in accordance with various embodiments of the invention are described in the following paragraphs.

Figure 5:
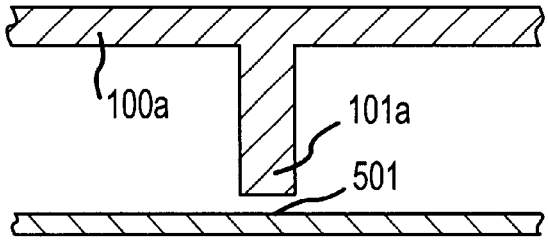
FIG. 5 illustrates, in a cross section view, a rib with a square foot.

Referring to FIG. 5, a square foot 101*a* connected to a web diaphragm 100*a* is illustrated in cross section prior to being sealed to surface 501. Surface 501 can be either a work piece surface or the surface of a wafer diaphragm. The square foot is easy to manufacture and provides a medium size contact area with the surface 501 to which it is to be sealed, but has limited gimballing characteristics.

Figure 6:
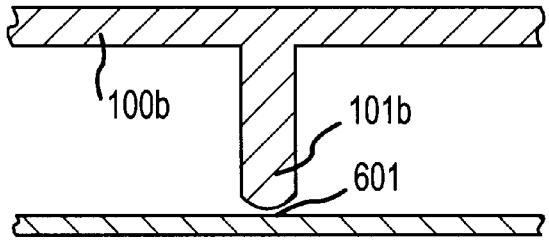
FIG. 6 illustrates, in a cross section view, a rib with a round foot.

Referring to FIG. 6, a rounded foot 101*b* connected to a web diaphragm 100*b* is illustrated in cross section prior to being sealed to surface 601. Surface 601 can be either a work piece surface or the surface of a wafer diaphragm. The rounded foot 101*b* is harder to manufacture than the square foot, has minimal contact area with the surface 601 to which it is to be sealed, but has excellent gimballing characteristics.

Figure 7:
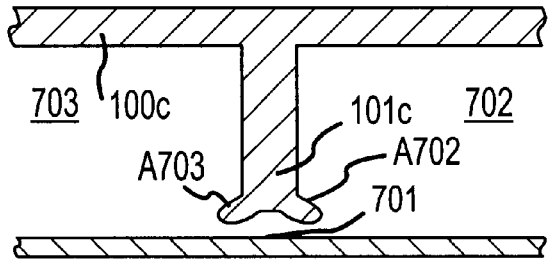
FIG. 7 illustrates, in a cross section view, a rib with an "elephant" or self-sealing foot.

Referring to FIG. 7, an "elephant" foot 101*c* connected to a web diaphragm 100*c* is illustrated in cross section prior to being sealed to surface to surface 701. Surface 701 can be either a work piece surface or the surface of a wafer diaphragm. The elephant foot 101*c* is more difficult to manufacture and has poor gimballing characteristics, but provides a large contact area with the surface 701 to which it is to be sealed. In addition, pressure in the neighboring web plenums 702 and 703 may be used to press on the elephant foot 101*c* as graphically illustrated by arrows A702 and A703 to assist the foot in sealing against surface 701.

Figure 8:
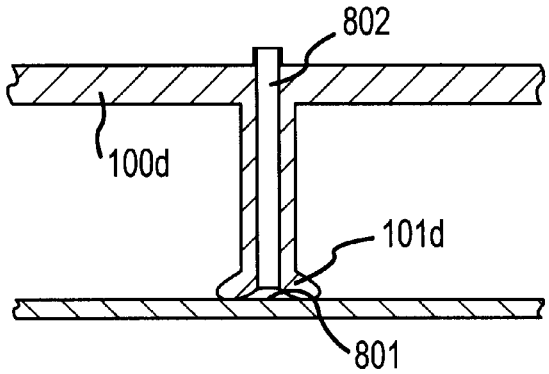
FIG. 8 illustrates, in a cross section view, a rib with a self-sealing foot with a vacuum assist system.

Referring to FIG. 8, an "elephant" foot 101*d* connected to a web diaphragm 100*d*, in accordance with yet another embodiment of the invention, is illustrated in cross section prior to being sealed to a surface 801. Surface 801 can be either a work piece surface or the surface of a wafer diaphragm. In accordance with this embodiment of the invention, a vacuum line 802 passes through the rib to rib foot 101*d* to assist in sealing the foot against a surface 801. Although the use of vacuum line 802 is shown in combination with the elephant foot design, such a vacuum line can also be used with other rib foot designs to improve their sealing capability.

Figure 3:
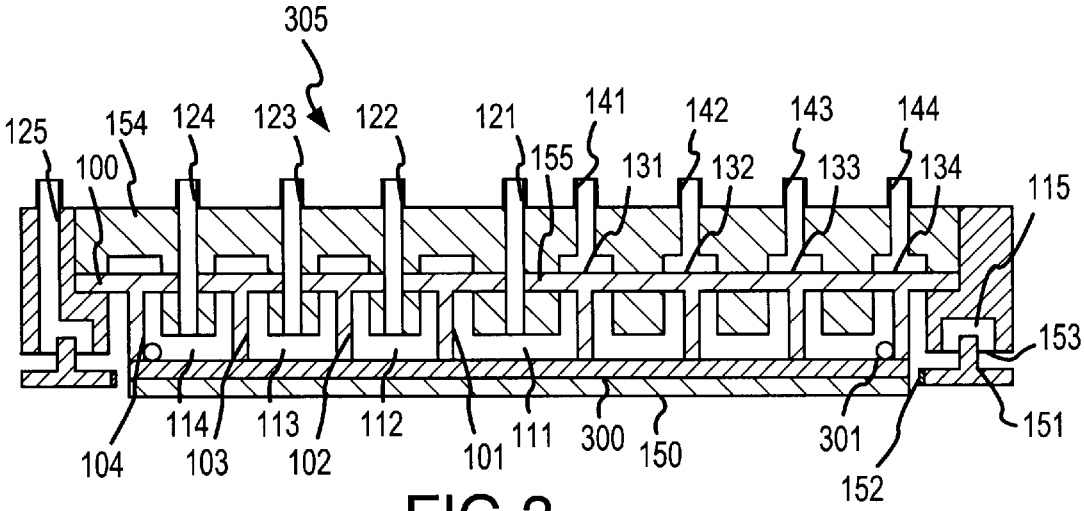
FIG. 3 illustrates, in a simplified cross section view, a carrier having adjustable concentric ribs defining adjustable pressure zones therebetween wherein the zones are enclosed by a wafer diaphragm.

FIG. 3 illustrates, in cross section, a work piece carrier 305 in accordance with a further embodiment of the invention. Carrier 305 has a similar carrier housing 154, carrier plenums 131–134, carrier fluid communication paths 141–144, web diaphragm 100, ribs 101–104, rib plenums 111–114, web fluid communication paths 121–124 and floating wear ring 151 as previously discussed. In addition, a wafer diaphragm 300 is positioned between wafer 150 and ribs 101–104 and is supported on the feet of the ribs 101–104. The ribs may be sealed against the wafer diaphragm in a manner similar to the sealing of ribs against wafer 150 in the previously described embodiment of carrier 156. In a preferred embodiment of the invention, ribs 101–104 are bonded to, or integrally molded in one piece with wafer diaphragm 300 to assist in preventing leakage between neighboring web plenums 111–114. As with the previously described embodiments, the number of web plenums can be selected depending on the particular conditions of the work piece being planarized.

In accordance with a further embodiment of the invention, a compressed spring ring 301 may be inserted in the outermost web plenum 114 near the junction between the outermost rib 114 and the wafer diaphragm 300. The spring ring 301 is advantageously designed to expand uniformly in a radial direction to assist in maintaining a taut wafer diaphragm 300.

Figure 12:
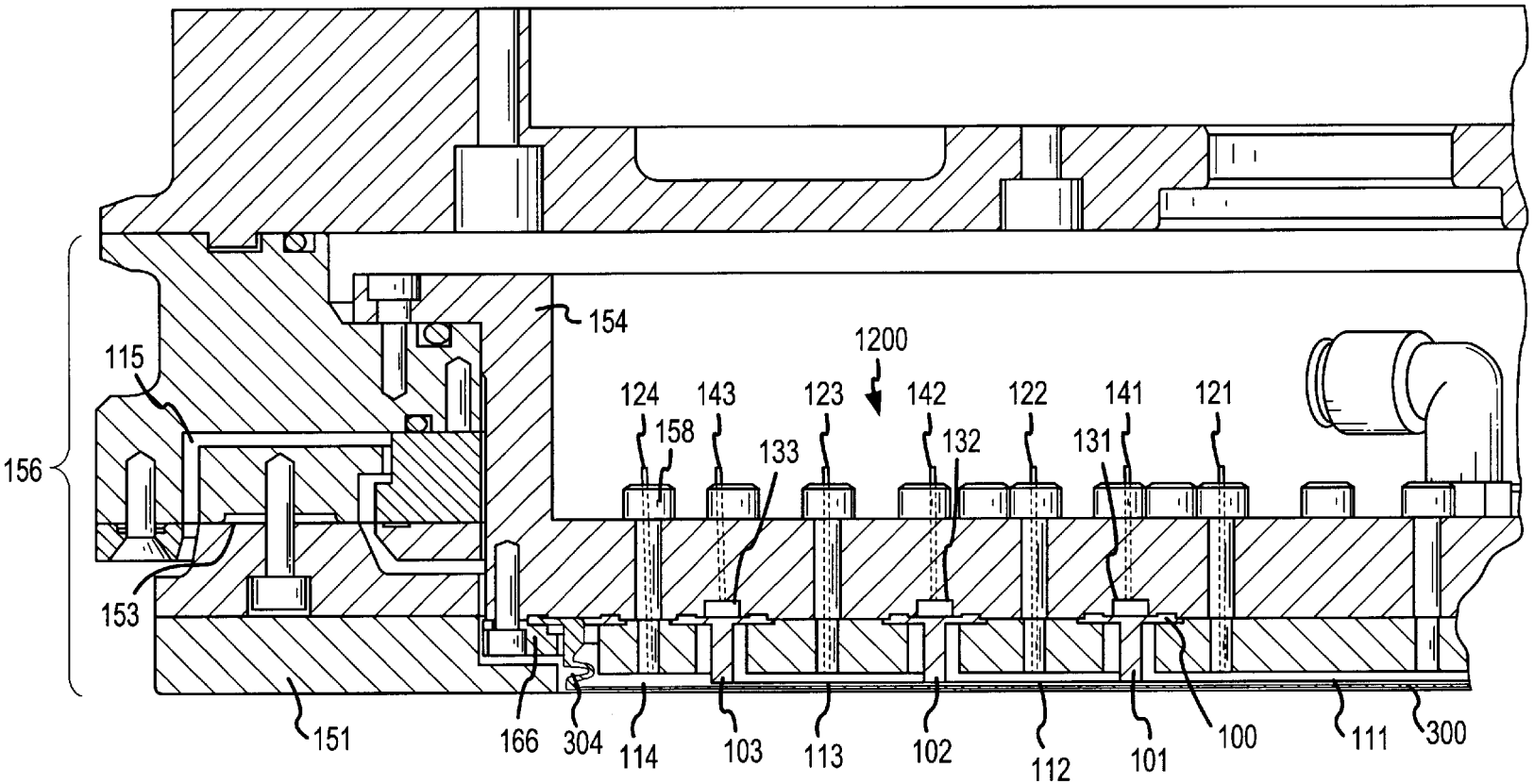
FIG. 12 illustrates, in a cross section view, a carrier having adjustable concentric ribs defining adjustable pressure zones wherein the zones are enclosed by a wafer diaphragm and the outermost rib is configured as a bellows.

FIG. 12 illustrates, in cross section, yet another embodiment of a work piece carrier 1200. Work piece carrier 1200 includes ribs 101–103, web plenums 111–114, carrier plenums 131–133, wear ring plenum 115, wear ring 151, carrier fluid communication paths 141–143 and web plenum fluid communication paths 121–124 as shown in the prior embodiments. However, the outermost rib 104, shown in FIG. 3, is replaced with a bellows 304. Bellows 304 does not need a carrier plenum 134 or carrier fluid communication path 144 (both shown in FIG. 3), thereby simplifying the design and construction of the carrier 1200.

Figure 9:
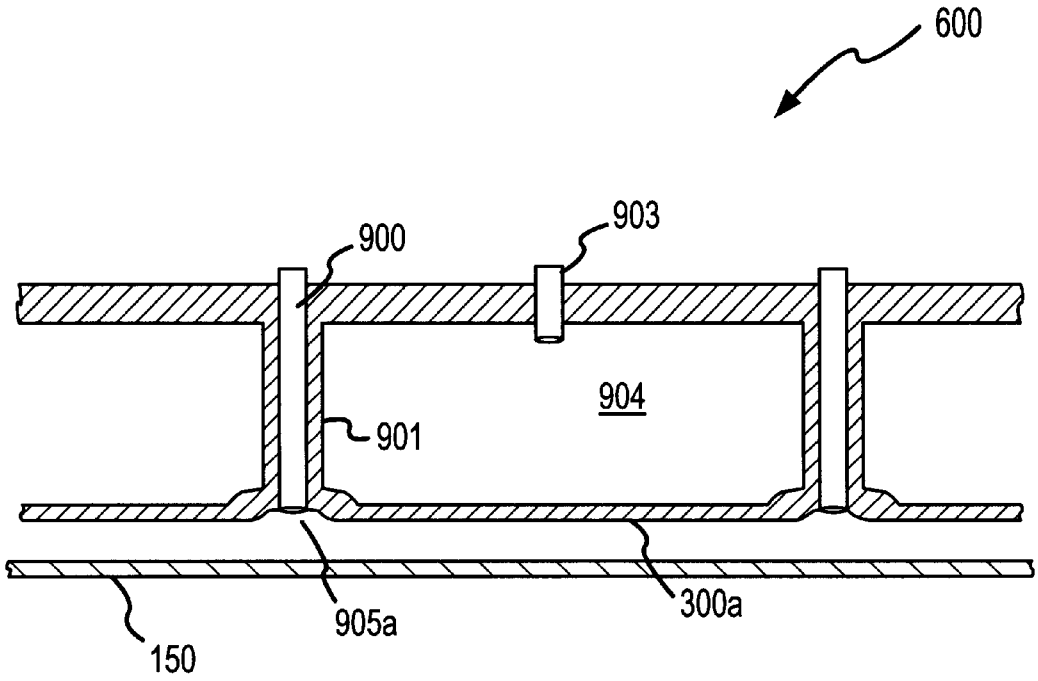
FIG. 9 illustrates, in a cross section view, another embodiment of the invention.

FIG. 9 illustrates, in cross section, a portion of a rib and diaphragm construction 600 in accordance with another embodiment of the invention. In accordance with this embodiment of the invention, wafer diaphragm 300*a* is attached to the plurality of ribs such as rib 901, thereby sealing web plenum 904. Web plenum 904 may be pressurized by web fluid communication path 903 in a manner similar to the other embodiments already discussed. This embodiment of the invention may be employed with any of the previously described work piece carriers. In accordance with one variation of this embodiment, one or more of the plurality of ribs can include a vacuum or discharge path 900 for either assisting in picking-up wafer 150 with a vacuum or removing wafer 150 from the carrier with a rapid discharge of fluids at point 905*a*.

Figure 13:
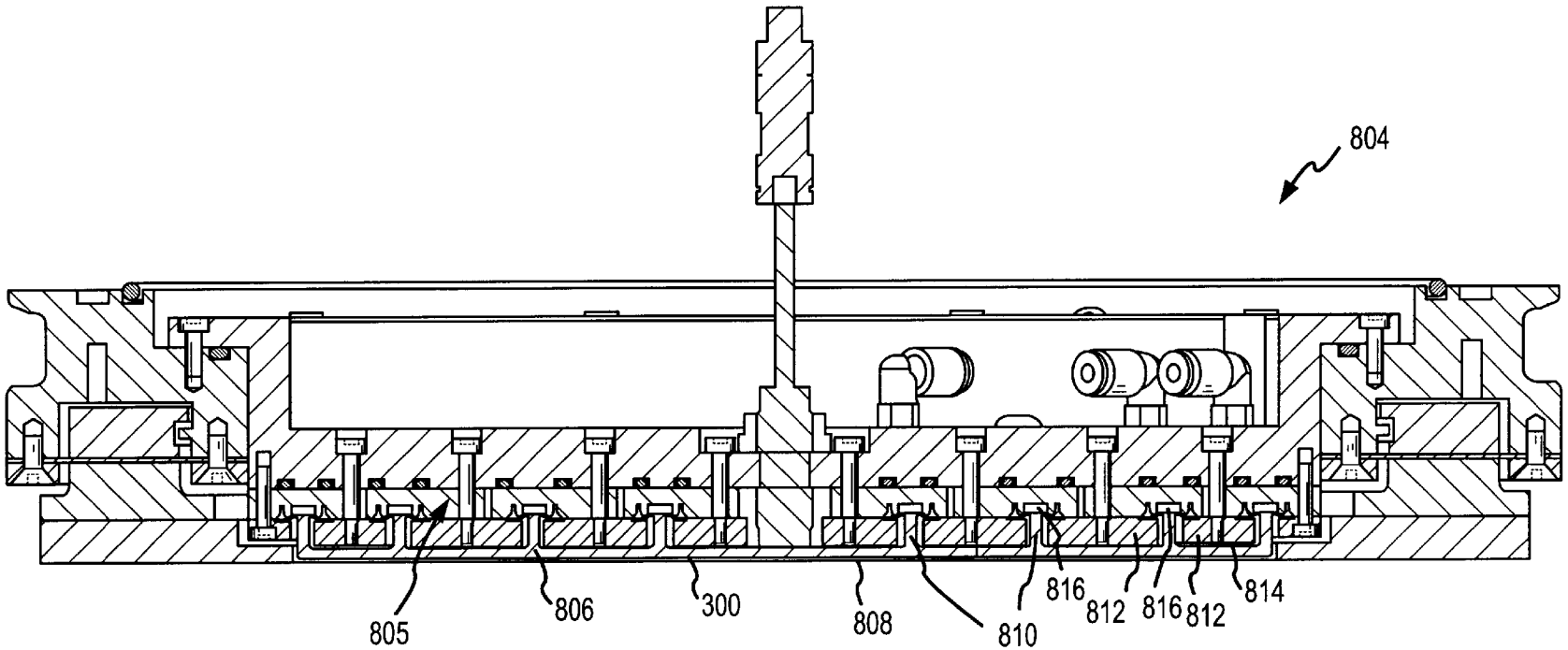
FIG. 13 illustrates, in cross section, a work piece carrier in accordance with a further embodiment of the invention.

The carriers in FIG. 3, FIG. 12, and FIG. 13 have the advantage of the wafer diaphragm 300 preventing the backside of the wafer 150 from being exposed to a fluid, such as air, that might cause the slurry to dry or adhere to the back surface of the wafer. Once slurry has dried or adhered to the wafer 150, it is extremely difficult to remove, thereby introducing contaminates that may be harmful to the wafer 150.

Carrier 156 in FIG. 1 and FIG. 11, carrier 305 in FIG. 3, and carrier 1200 in FIG. 12 may be used to pick-up a wafer 150 by creating one or more low pressure zones at the back surface of the wafer. A low pressure zone may be created by one or more of the web fluid communication paths 121–124 communicating a low pressure to one of the web plenums 111–114. The low pressure for carrier 156 in FIG. 1 and FIG. 11 is communicated directly to the back surface of wafer 150. The low pressure for carrier 305 in FIG. 3 or carrier 1200 in FIG. 12 lifts wafer diaphragm 300 from the backside of wafer 150 creating a reduced pressure between the wafer diaphragm and the wafer.

Carrier 156 in FIG. 1 and FIG. 11, carrier 305 in FIG. 3, and carrier 1200 in FIG. 12 may also be used to discharge a wafer 150 from the carrier. A rapid discharge of fluids through one or more of the web fluid communication paths for carrier 156 in FIG. 1 and FIG. 11 will directly impact wafer 150 and force the wafer away from the carrier. A wafer 150 in carrier 305 in FIG. 3 or carrier 1200 in FIG. 12 may be removed from the carrier by pressurizing web plenums 111–114 which will cause wafer diaphragm 300 to extend outwardly thereby dislodging the wafer from the carrier.

Wear ring 151, illustrated schematically in FIGS. 1 and 3 and illustrated in more detail in FIGS. 11 and 12, is made of a mechanically stiff, chemically resistant material that can withstand the environment presented by the chemically reactive and abrasive slurry used in a CMP operation. The wear ring can be made of stainless steel, ceramic materials such as boron nitride, or the like. Often the wear ring includes a resilient liner 152 such as a plastic liner as illustrated in FIG. 1. The liner protects both the edge of the wafer and the edge of the wear ring from collisions between the wafer and the wear ring that may occur during the CMP operation. In some applications it may be advantageous to extend the liner to cover the entire bottom surface of the wear ring. Recall that the wear ring is toroidal in shape and is positioned to surround the wafer and to confine the wafer beneath the carrier housing. In accordance with one embodiment of the invention, as illustrated in FIGS. 11 and 12, wear ring 151 is thicker at its outer periphery than adjacent its inner diameter. The thick outer periphery lends stiffness to the wear ring while the thinner inner portion accommodates clamp 166 that clamps rib 104 or bellows 304 (or, in general, the outer periphery of the wafer diaphragm), as the case may be. By shaping wear ring 151 in this manner, the wear ring may be positioned close to the edge of work piece 150, with the edge of the work piece aligned near the outer edge of the outermost rib or the outer edge of the wafer diaphragm and without causing the wear ring to contact clamp 166. At the same time the thicker outer portion of the wear ring provides the necessary stiffness.

FIGS. 13–17 illustrate, in accordance with a further embodiment of the invention, a work piece carrier 804 that can be easily assembled and that provides control of the pressure in multiple pressure zones as a wafer diaphragm is pressed against the back side of a work piece that is to be planarized. FIG. 13 illustrates the work piece carrier in cross section. The carrier includes carrier insert 805 closely circumferentially surrounded by a floating wear ring 151. The floating wear ring can be similar to the wear rings described above. Carrier insert 805 provides an easily assembled and aligned combination of a wafer bladder 806 that includes wafer diaphragm 808 and ribs 810, clamps 812, web plenums and carrier plenums that interface with appropriate carrier fluid communication paths and web fluid communication paths in a manner similar to that previously described. The carrier insert can be assembled and the plenums leak checked before insertion into and attachment to the work piece carrier.

Figure 16:
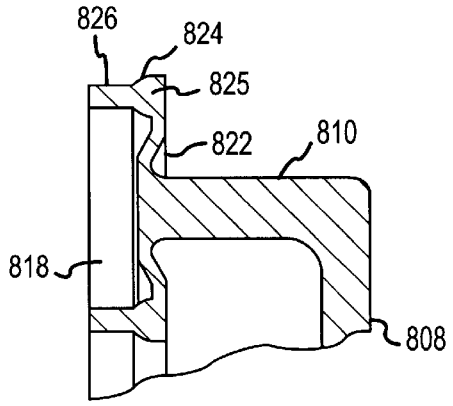
FIG. 16 illustrates, in cross section, a portion of a wafer bladder in more detail.
Figure 14:
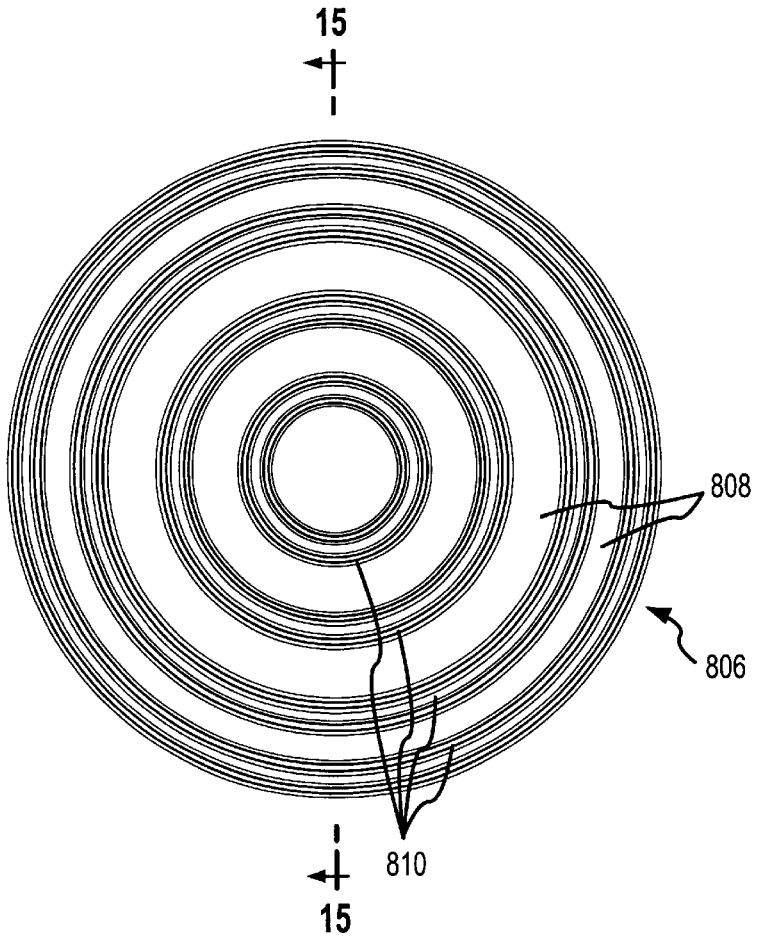
FIGS. 14 and 15 illustrate, in bottom view and cross sectional views, respectively, a work piece bladder in accordance with an embodiment of the invention.
Figure 15:
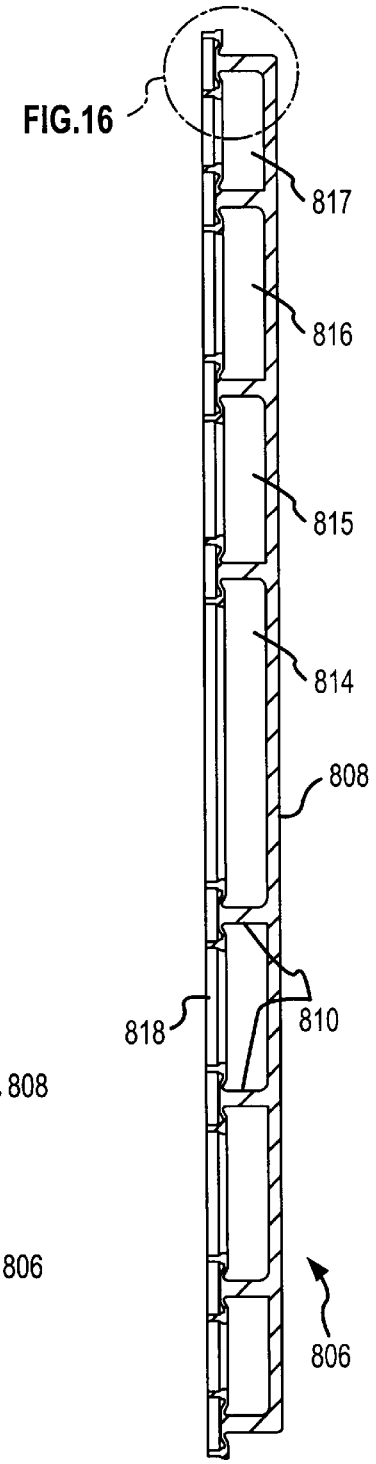
Figure 17:
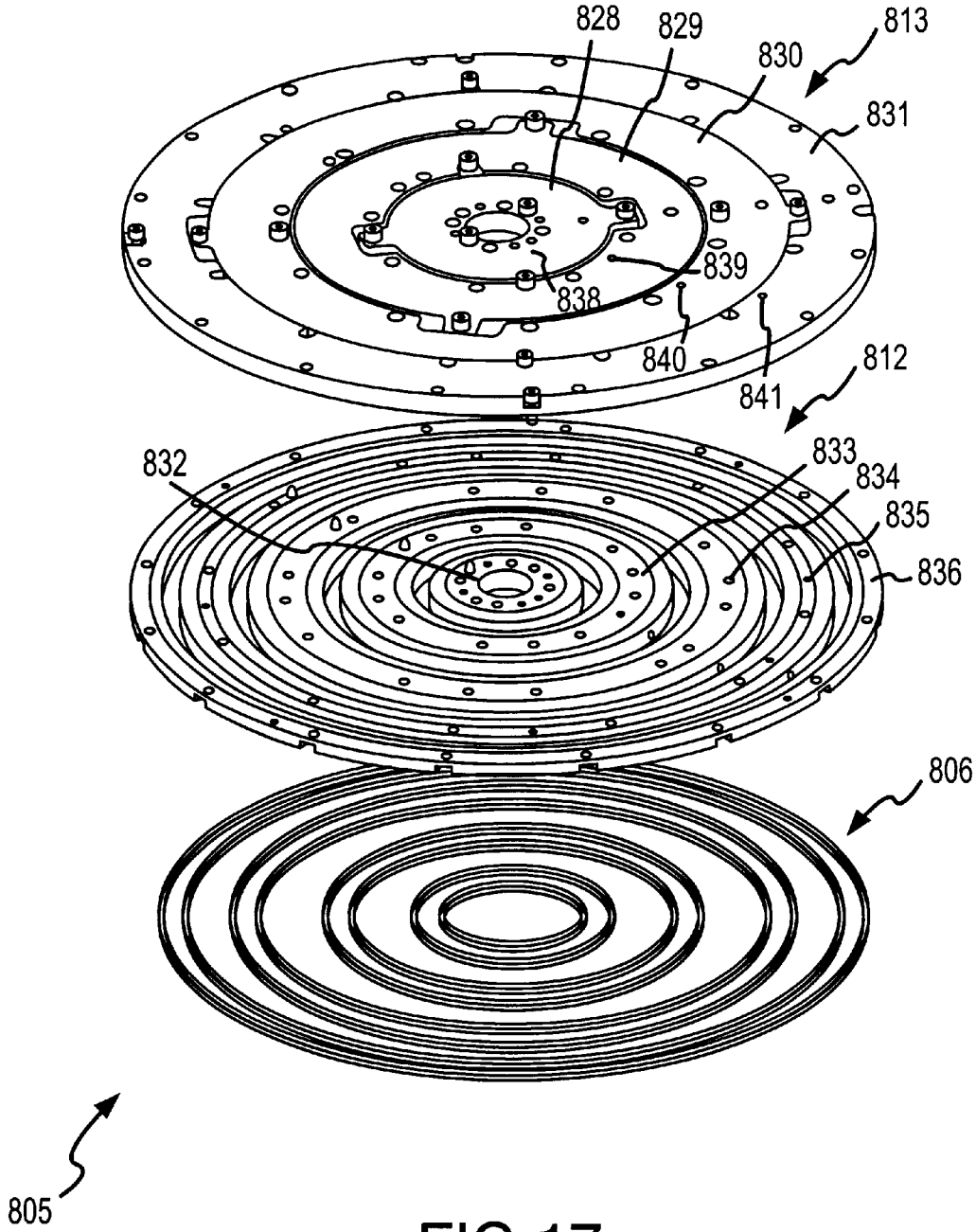
FIG. 17 illustrates, in exploded perspective view, a work piece carrier insert in accordance with an embodiment of the invention.
Figure 18:
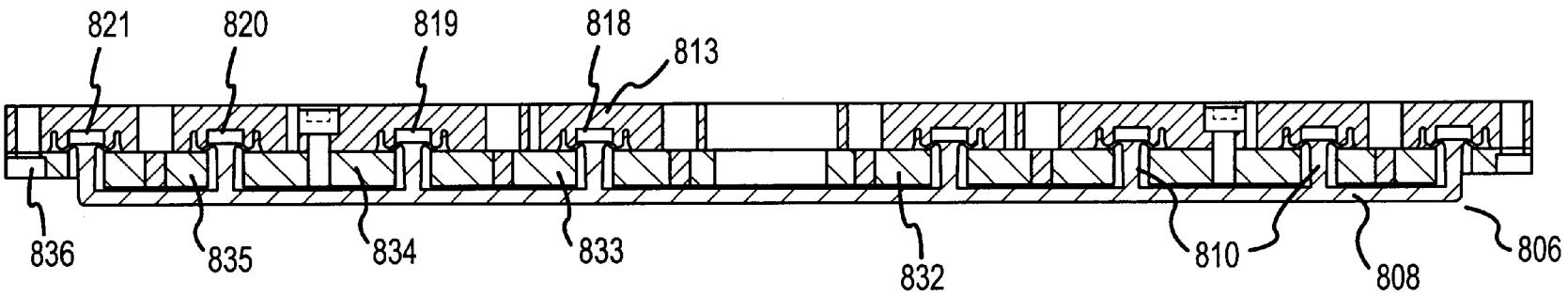
FIG. 18 illustrates, in a cross section of a portion of the carrier insert, the manner in which the bladder is secured to the backing plate in accordance with an embodiment of the invention.

FIG. 14 illustrates, in top view, a wafer bladder 806 in accordance with this embodiment of the invention. FIG. 15 illustrates wafer bladder 806 in cross section, and FIG. 16 illustrates a portion of a preferred embodiment of wafer bladder 806 in more detail. In FIGS. 17 and 18 the wafer bladder is illustrated in combination with a portion of a carrier backing plate 813 to be described in more detail below. The wafer bladder is joined to the carrier backing plate by a plurality of clamps 812, also described in more detail below. As illustrated in FIG. 14 and FIG. 15, wafer bladder 806 includes a wafer diaphragm 808 and a plurality of concentric circular ribs 810. Preferably the diaphragm and ribs are integrally formed from a single piece of elastic material. The innermost rib defines the periphery of a central disk shaped web plenum 814. The other ribs define the bounds of a plurality of concentric web plenums 815–817. A plurality of carrier plenums 818–821 are defined by circular channels in the carrier backing plate at the upper end of each of the ribs and sealed by the ribs.

FIG. 16 illustrates a preferred configuration for the upper end of each of ribs 810. Each of the ribs extends substantially orthogonal to the wafer diaphragm. As illustrated, each of the ribs terminates in an expanded portion 822 that is substantially parallel to the wafer diaphragm and that facilitates reliable sealing between the rib and the carrier backing plate. Preferably the expanded portion further includes a shaped upwardly extending portion 824 that can be inserted into a similarly shaped channel in the carrier backing plate. Here the term "upwardly extending" indicates the shaped portion extends away from the wafer diaphragm, a direction that will generally be in an upward direction during a planarization operation. The shaped portion includes a bulbous portion 825 and a narrow alignment portion 826. The alignment portion aids in aligning the upwardly extending portion with the corresponding channel. The bulbous portion is configured to be squeezed and flattened against the carrier backing plate by the clamping arrangement to insure an air tight seal between the rib and the backing plate.

FIG. 17 illustrates, in exploded perspective view, the major components of work piece carrier insert 805 in accordance with one embodiment of the invention. The major components of the work piece carrier insert include wafer bladder 806, described above, carrier backing plate 813, and clamps 812 for securing the wafer bladder to the backing plate. FIG. 18 illustrates, in a cross section of a portion of the carrier insert, the manner in which the bladder is secured to the backing plate in accordance with this embodiment of the invention. Because of the complexity of the carrier insert assembly, it has been found advantageous to form both the backing plate and the clamp in multiple section. For a carrier insert having a central disk shaped web plenum and three concentric web plenums, carrier backing plate 813 is formed of four concentric toroidal shaped components 828–831 and clamp 812 is formed of five components 832–836. Although, of necessity, clamp 812 must be formed of multiple components, carrier backing plate can be formed as a single unitary component instead of a plurality of individual components. As seen more clearly in FIG. 18, each of clamps 832–835 fit inside the wafer bladder between adjacent ribs and underneath expanded portion 822 of the ribs. Clamp 836 fits around the outside of the wafer bladder and secures the outer portion of the outermost rib to the carrier backing plate. As illustrated in FIG. 13, the position of clamp 836 and the close juxtaposition of the edge of bladder 806 to the inner diameter of wear ring 151 is facilitated by the thin inner portion of wear ring 151. The clamps are secured to the carrier backing plate by threaded fasteners that pass through the backing plate into threaded holes in the clamps. By tightening the threaded fasteners, the wafer bladder is sealed to the respective components of the carrier backing plate. A plurality of holes, for example holes 838–841, extend through the carrier backing plate to couple each of the web plenums to corresponding web fluid communication paths and to couple each of the carrier plenums to corresponding carrier fluid communication paths. In accordance with one embodiment of the invention, to facilitate the alignment of holes 838–841 with their respective plenums and to facilitate the alignment of the clamps to the rib extensions and the rib extensions to the carrier backing plate, the carrier backing plate is formed of an optically transparent material such as a transparent, rigid plastic material. The transparent material allows visual alignment of the various components as the work piece carrier insert is assembled. If the carrier backing plate is not transparent, the assembly of the many components must be a blind assembly and success or failure of the assembly process cannot be known until the entire insert is assembled and leak tested. The threaded fasteners passing through the four components of the carrier backing plate and threading into the five clamping rings join the plurality of components into a single unitary composite work piece carrier insert that can be bolted or otherwise fastened into work piece carrier 804.

Figure 10:
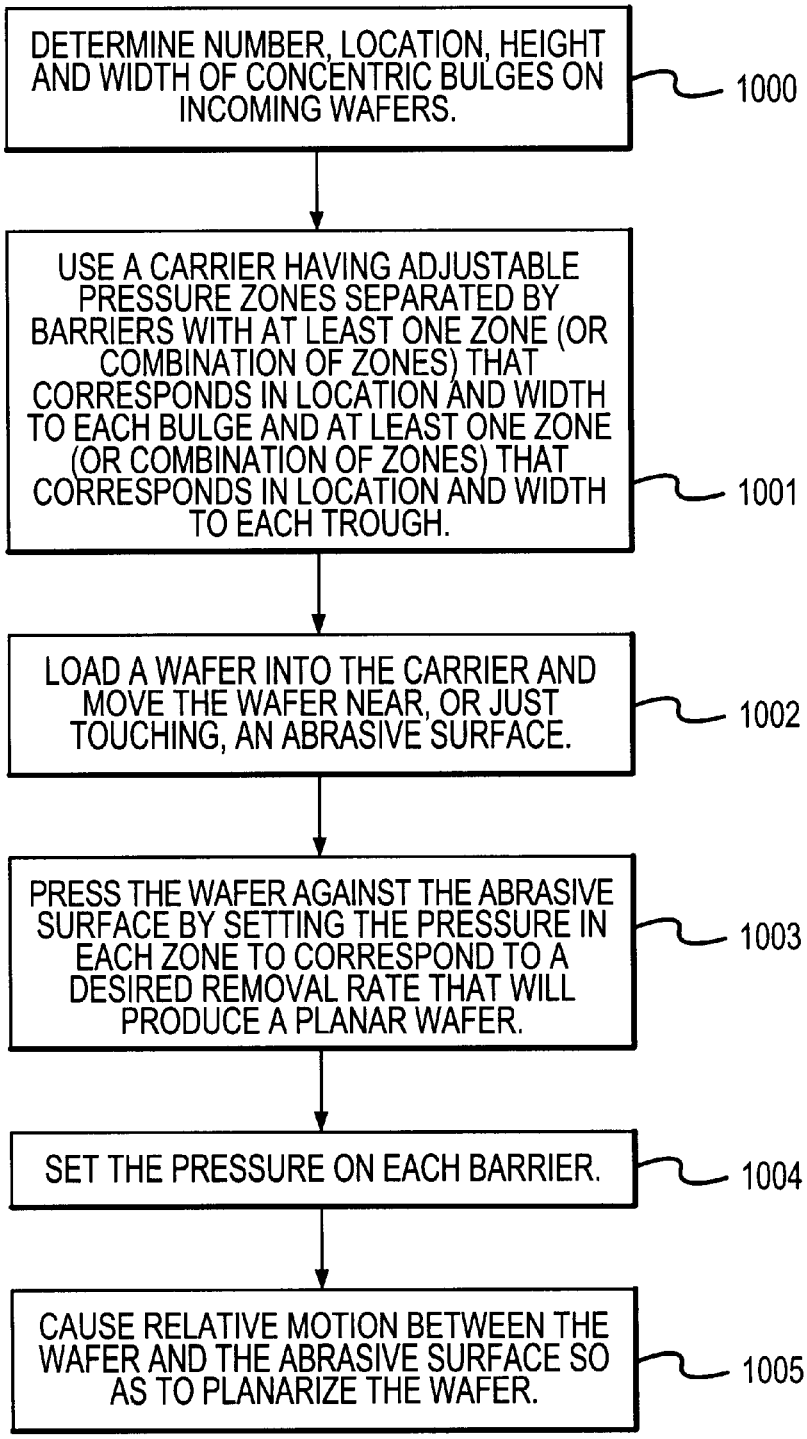
FIG. 10 is a flow chart of an exemplary process to practice the invention.

A process for planarizing a semiconductor wafer in accordance with one embodiment of the invention will now be discussed with reference to FIG. 10, which illustrates the process in flow chart form, and with additional reference to FIG. 4 which depicts pressure settings in accordance with a particular exemplary process. It is known that certain semiconductor wafer processing steps leave predictable concentric bulges on the wafer and that the bulges from these processing steps are substantially the same from wafer to wafer in a processing lot. For example, current copper deposition processes typically have a narrow bulge near the periphery of the wafer and another bulge in the shape of a small disk near the center of the wafer. Likewise, current STI processes typically have a wide bulge near the periphery of the wafer and another bulge in the shape of a small disk near the center of the wafer. Therefore, to properly planarize such wafers, the first step is to determine the number, location, height and/or width of concentric bulges on incoming wafers (step 1000). This characterization may be done by measuring incoming wafers prior to planarization with various known metrology instruments, such as a UV1050 manufactured by KLA-Tencor located in San Jose, Calif.

After characterizing the surface geometry of the wafers to be planarized, a carrier with adjustable concentric pressure zones that correspond to the surface geometry of the incoming wafers is selected for use (step 1001). The carrier should have adjustable pressure zones that correspond to the bulges and adjustable pressure zones that correspond to the troughs between bulges on the wafer.

A wafer to be processed is then loaded into the selected carrier and the carrier and wafer are positioned so that the wafer is parallel to and adjacent (near or just touching) a polishing pad (step 1002). The wafer is then pressed against the polishing pad in the presence of a polishing slurry by pressurizing the independently controlled pressure zones (web plenums). The appropriate pressure in each zone, as determined by the previously completed wafer surface characterization, is independently established by adjusting the pressure communicated through the corresponding web fluid communication path to provide an optimum planarization process for the surface geometry of that wafer (step 1003).

Figure 4:
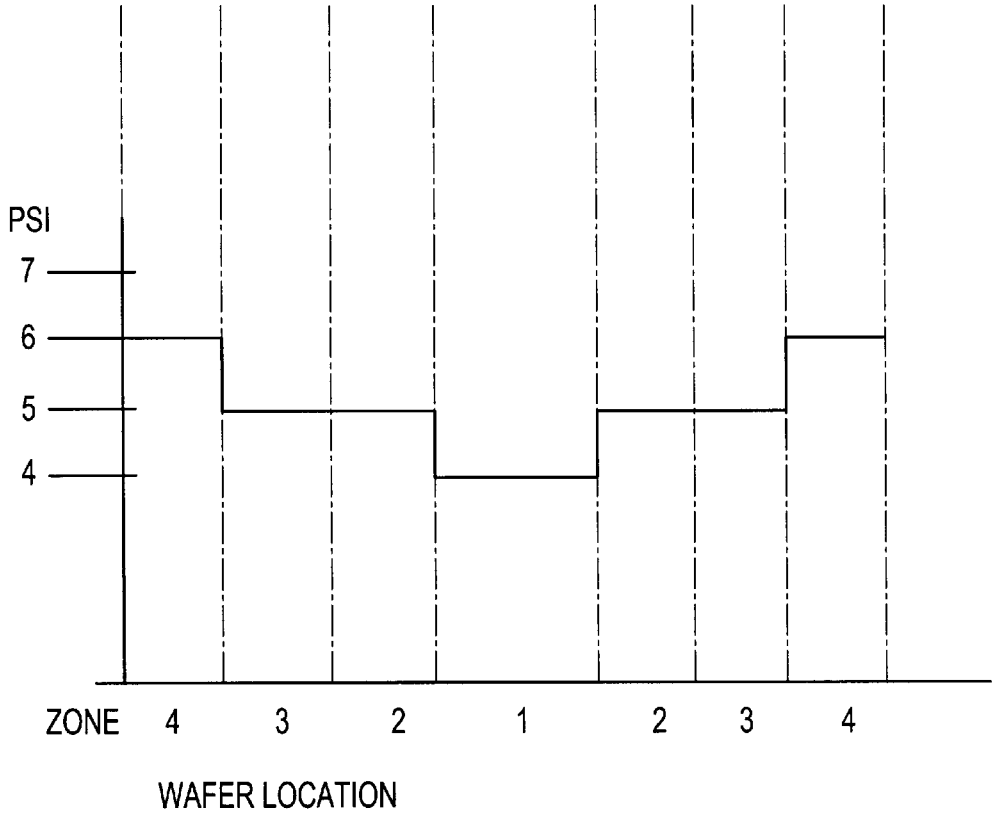
FIG. 4 is a graph relating pressure to corresponding zones on the back surface of a wafer.

FIG. 4 illustrates one possible pressure distribution to be applied to the back surface of a wafer by a carrier having a central zone 1 and three surrounding zones 2–4. The central zone 1 (web plenum 111 in FIG. 3) is pressurized to 4 psi, zones 2 and 3 (web plenums 112 and 113 respectively in FIG. 3) are pressurized to 5 psi and zone 4 (web plenum 114 in FIG. 3) is pressurized to 6 psi. This distribution of pressure on the back surface of a wafer may be used for wafers with a thin bulge around the periphery and a small depression near the center of the wafer. The variation of pressures allows the carrier to exert more force against those portions of the wafer with bulges and to exert less force against those portions of the wafer with troughs or depressions during the planarization process. This will produce a wafer with a substantially planar surface. Additional zones, smaller zones or zones of varying sizes may be used to give finer control over the distribution of pressure on the back surface of the wafer, as needed.

A single carrier design with four roughly equal zones, as illustrated in FIG. 1 and FIG. 3, may be advantageously used for both copper deposition and STI wafers in this situation. For a specific example, zones 1 and 4 that correspond to bulges on a copper deposition wafer may have a higher pressure, e.g. 6 psi, while the zones 2 and 3 that correspond to the trough may have a lower pressure, e.g. 5 psi. Likewise, zones 1, 3 and 4 that correspond to bulges on an STI wafer may have a higher pressure, e.g. 6 psi, while zone 2 that corresponds to a trough may have a lower pressure, e.g. 5 psi. This strategy allows one carrier design to be used to planarize wafers after two different processes.

In accordance with a further embodiment of the invention, the carrier plenums may be individually pressurized by passing pressurized fluid through corresponding carrier fluid communication paths. Each pressurized carrier plenum exerts a force against the head of a corresponding rib and that force is transmitted through the rib to assist in pressing the feet of the rib against the back surface of the wafer (or wafer diaphragm if one is used). This pressing force assists the feet of the ribs in making a good seal with the back surface of the wafer. The pressure in the carrier plenums may be made equal to or slightly greater (about 0.1 to 0.3 psi) than the pressure in the neighboring web plenums to assist in preventing leakage between neighboring web plenums (step 1004). Alternatively, the pressure in each carrier plenum may be appropriately set at a value such as a pressure between the pressure in its neighboring web plenums to create a smoother distribution of pressure on the back surface of the wafer.

With the wafer pressed against the abrasive surface of a polishing pad, relative motion is provided between the wafer and the abrasive surface to remove material from the front surface of the wafer thereby planarizing that surface. The abrasive surface and/or carrier of the present invention may be rotated, orbited, linearly oscillated, moved in particular geometric patterns, dithered, moved randomly or moved in any other motion that removes material from the front face of the wafer. In addition, the abrasive surface and/or carrier may be moving relative to each other prior to, or after, the front face of the wafer contacts the abrasive surface (step 1005). In a preferred embodiment, relative motion between the wafer surface and the polishing pad is generated by the carrier rotating and the polishing pad orbiting. The carrier and polishing pad motion may be ramped up to their desired speeds simultaneously with the pressure on the back surface of the wafer being ramped to its desired level. An appropriate polishing slurry is introduced to the interface between the wafer and the polishing pad during the step of providing relative motion. The slurry chosen depends on the materials to be removed by the CMP operation.

Figure 19:
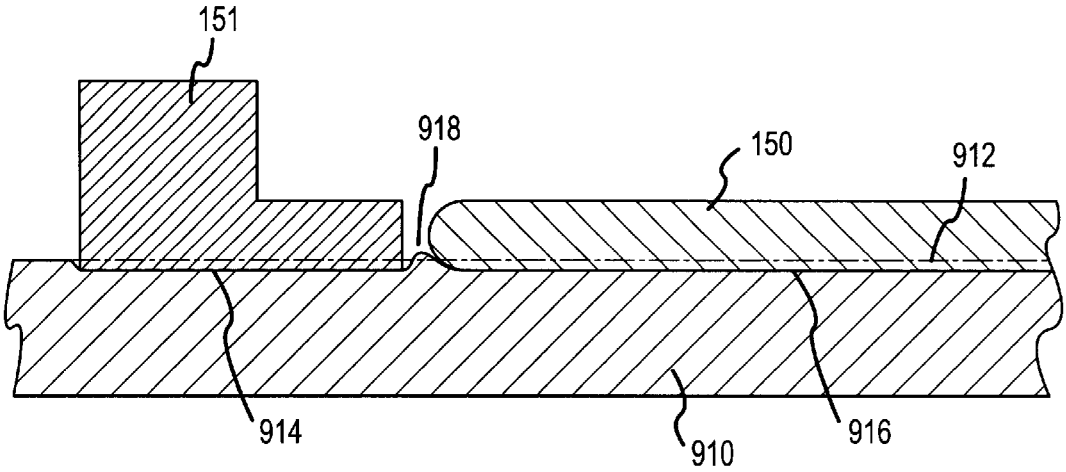
FIG. 19 illustrates, in cross section, the effect of a wear ring pressing on a polishing pad.

FIG. 19 illustrates, in cross section, the resultant effect on a polishing pad 910 as a consequence of wear ring 151 pressing on that pad in advance of the leading edge of a wafer 150 being pressed against the pad. Polishing pad 910 is generally made of a resilient, compressible material. The natural, relaxed state of the polishing pad is indicated in FIG. 19 by the dashed line 912. As part of the CMP operation, as the work piece carrier and its wear ring and the attached wafer are in relative motion with respect to the polishing pad, the wear ring is pressed against the surface of polishing pad 910 to pre-compress or pre-condition the pad. The compressed surface of polishing pad 910 directly under the wear ring is indicated at 914. Similarly, the surface of the polishing pad directly under wafer 150 is indicated at 916. Despite the positioning of wafer 150 in close proximity to the inner diameter of wear ring 151, the compressed surface of polishing pad 910 tends to rebound immediately after the passage of the wear ring. This rebound occurs even if the spacing between the wear ring and the edge of the wafer is a preferred distance of 1 mm or less. The rebound of the surface of polishing pad 910 is indicated at 918. The rebound in the surface of polishing pad 910 in the interval between the wear ring and the leading edge of the wafer being planarized, unless properly controlled, can cause uneven removal of material from the portion of the wafer surface near the outer edge of the surface.

Figure 20:
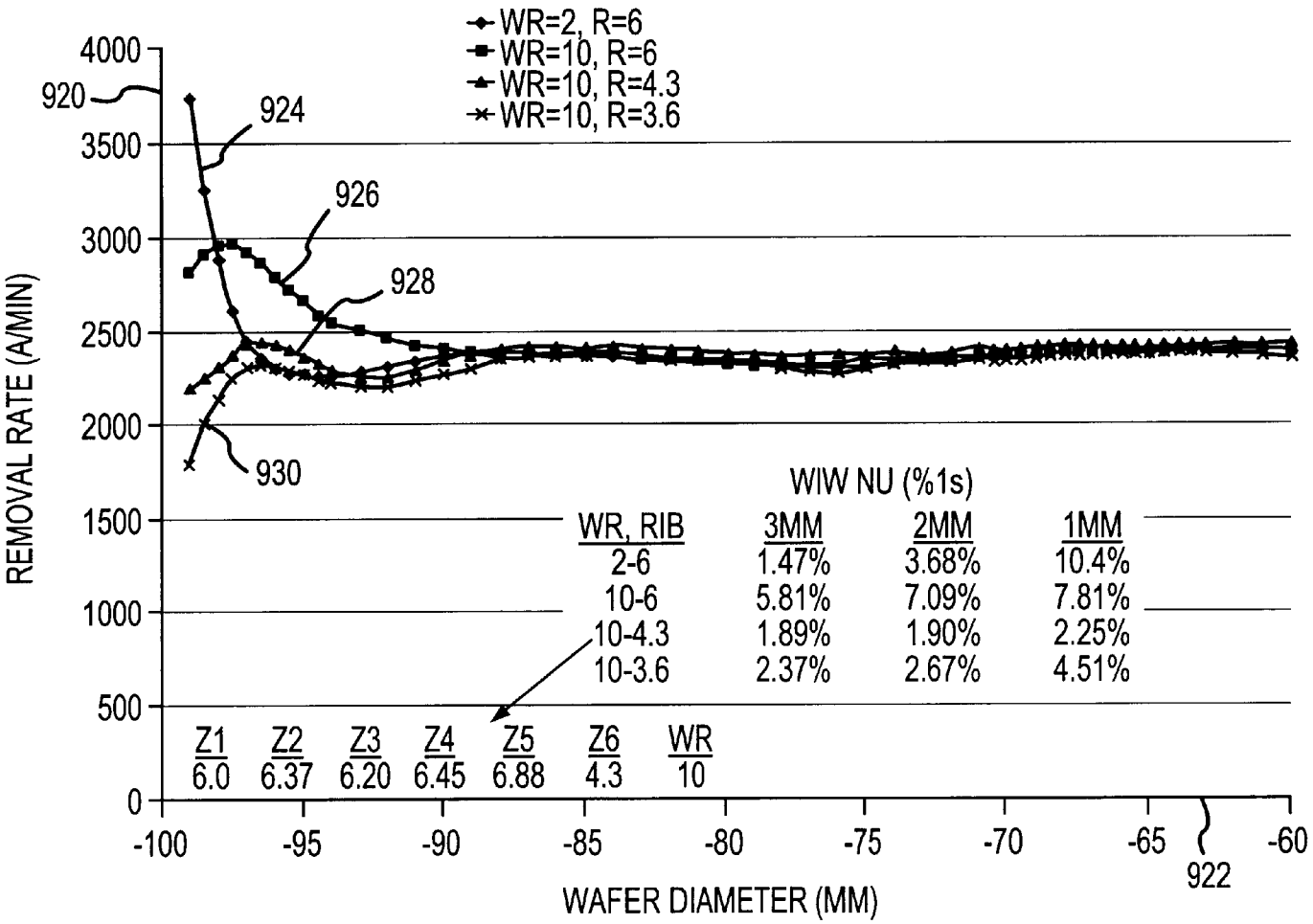
FIG. 20 illustrates graphically the effect on removal rate of wear ring and outer rib pressure.

In accordance with one embodiment of the invention, the rebound in the polishing pad and hence the polishing results on a wafer to be planarized can be controlled by properly selecting the pressure applied to the wear ring, and hence the force exerted on the polishing pad by the wear ring, and the pressure applied to the outermost rib of the wafer bladder, and hence the force exerted on the polishing pad by the extreme edge of the wafer. FIG. 20 illustrates, in graphical form, the effect on material removal rate across the surface of a wafer being planarized as a result of adjusting the pressure applied to the wear ring and the pressure applied to the outermost rib of the wafer bladder. Vertical axis 920 indicates removal rate of material from the surface of the wafer being planarized. Horizontal axis 922 indicates position along outermost 40 mm of a diameter of a 200 mm diameter wafer. The wafer being planarized was a silicon wafer having a thermally grown silicon dioxide layer on the upper surface thereof. The pressure in each of the web plenums was set to 6 psi. The pressure in each of the carrier plenums except for the outermost carrier plenum was also set at 6 psi. The pressure in the outermost carrier plenum and thus the pressure applied to the outermost rib of the wafer bladder was adjusted between 3.6 psi and 6 psi, as indicated. The pressure applied to the wear ring was set at either 2 psi or 10 psi, as indicated. For curve 924, the wear ring pressure was 2 psi and the outermost ring pressure was 6 psi. For curve 926, the wear ring pressure was 10 psi and the outermost ring pressure was 6 psi. For curve 928, the wear ring pressure was 10 psi and the outermost ring pressure was 4.3 psi. For curve 930, the wear ring pressure was 10 psi and the outermost ring pressure was 3.6 psi. As can be seen from the illustrated results, the removal rate at the edge of the wafer can be controlled by adjusting the pressure applied to the wear ring and by simultaneously and independently adjusting the pressure applied to the outermost rib of the wafer bladder. Other wafer surface conditions such as ridges or depressions in the surface of the wafer to be planarized and other variables in the processing equipment or processing conditions can be accommodated by adjustments in the pressure in the other web plenums and the other carrier plenums. Such adjustments of the pressure in the other web and carrier plenums can be made independently of the pressure applied to the outermost rib and the pressure applied to the wear ring.

Although the foregoing description sets forth preferred exemplary embodiments and methods of operation of the invention, the scope of the invention is not limited to these specific embodiments or described methods of operation. Many details have been disclosed that are not necessary to practice the invention, but have been included to sufficiently disclose the best mode of operation and manner and process of making and using the invention. Modification may be made to the specific form and design of the invention without departing from its spirit and scope as expressed in the following claims.

We claim:

1. A carrier for planarizing a first surface of a work piece comprising:

a carrier housing;

a carrier insert coupled to the work piece carrier housing, the carrier insert comprising:

a work piece bladder having a work piece diaphragm with a surface configured to press against a second surface of a work piece and having a plurality of ribs integrally formed with the work piece diaphragm;

an optically transparent carrier backing plate adapted for coupling to the carrier housing; and a plurality of clamps for scaling the ribs to the carrier backing plate;

a plurality of web plenums bounded by the work piece diaphragm, ribs, and carrier backing plate and in each of which the pressure can be controlled; and a plurality of carrier plenums bounded by the ribs and the carrier backing plate and in each of which the pressure can be controlled to control pressure exerted on a corresponding one of the plurality of ribs; and a floating wear ring coupled to the carrier housing and surrounding and closely spaced apart from the work piece bladder.

2. The carrier of claim 1 wherein the floating wear ring comprises a thick portion adjacent the outer periphery of the wear ring a and a thin portion adjacent the inner periphery of the wear ring, the thin portion configured to accommodate one of the plurality of clamps sealing the outermost of the ribs to the carrier backing plate.

3. The carrier of claim 1 wherein each of the plurality of ribs comprises an expanded portion that facilitates scaling between the rib and the carrier backing plate.

4. The carrier of claim 3 wherein the expanded portion comprises a bulbous portion and an alignment portion.

5. The carrier of claim 1 wherein the carrier backing plate comprises a plurality of individual components coupled together by the plurality of clamps.

6. The carrier of claim 1 wherein the plurality of carrier plenums comprise circular channels formed in the carrier backing plate.

7. The carrier of claim 1 wherein the floating wear ring is coupled to the carrier housing by a wear ring diaphragm that bounds one portion of a wear ring plenum in which the pressure can be adjusted.

8. The carrier of claim 1 wherein a first clamp of the plurality of clamps is positioned to surround the periphery of the work piece bladder, and the remaining clamps of the plurality of clamps are positioned within the plurality of web plenums.

9. The carrier of claim 8 wherein the floating wear ring comprises toroidal ring having a thick outer portion and a thin inner portion, the thin inner portion configured to avoid contact between the first clamp and the floating wear ring.

10. A carrier insert for a CMP apparatus comprising:

a work piece bladder comprising a work piece diaphragm and a plurality of concentric ribs integrally formed with the work piece diaphragm;

an optically transparent carrier backing plate adapted for coupling to the CMP apparatus; and a plurality of circular clamps coupled to the carrier backing plate and sealing the plurality of ribs to the carrier backing plate.

11. The carrier insert of claim 10 further comprising a plurality of web plenums bounded by the work piece diaphragm, the concentric rings and the carrier backing plate.

12. The carrier insert of claim 11 further comprising a plurality of carrier plenums formed in the carrier backing plate, each of the plurality of carrier plenums bounded by one of the plurality of concentric ribs.

13. The carrier insert of claim 12 further including a plurality of holes formed in the carrier backing plate for coupling the plurality of carrier plenums and plurality of web plenums to fluid carrier paths in the CMP apparatus.

14. The carrier insert of claim 10 wherein the carrier bucking plate comprises a plurality of toroidal rings.

15. The carrier insert of claim 14 wherein the plurality of toroidal rings are coupled together in a unitary structure by the plurality of circular clamps.

16. The carrier insert of claim 10 wherein each of the plurality of concentric ribs comprises a first portion joined to the work piece diaphragm and extending orthogonally therefrom, and a second expanded portion at the extremity of the rib to facilitate sealing of the rib to the carrier backing plate by at least one of the plurality of circular clamps.

17. The carrier insert of claim 16 wherein the second expanded portion comprises a shaped portion including a first bulbous portion and a second alignment portion.

18. A work piece bladder for use with a CMP apparatus comprising a work piece diaphragm having a first surface adapted for pressing against a surface of a work piece and a plurality of concentric ribs extending substantially orthogonally from a second surface of the work piece diaphragm, each of the plurality of concentric ribs terminating in an expanded portion substantially parallel to the work piece diaphragm, the expanded portion adapted for clamping to a carrier backing plate of a CMP apparatus, the expanded portion comprising a shaped, upwardly extending portion having a first bulbous portion and a second alignment portion.

19. A method for planarizing a first surface of a work piece utilizing a CMP apparatus comprising: a polishing pad, a work piece diaphragm supported by a plurality of ribs including an outermost rib, each of the ribs having a pressure adjustable carrier plenum associated therewith, the work piece diaphragm having a first surface for pressing against a second surface of the work piece, a plurality of pressure adjustable web plenums positioned adjacent a second surface of the work piece diaphragm, and a wear ring surrounding the work piece diaphragm and configured to press against the polishing pad, the pressure with which the wear ring presses against the polishing pad being adjustable, the method comprising the steps of:

positioning a second surface of a work piece adjacent the first surface of the work piece diaphragm;

positioning the first surface of the work piece in contact with the polishing pad;

establishing a predetermined pressure in each of the pressure adjustable web plenums;

pressing the wear ring against the polishing pad with a predetermined force;

adjusting, independent of the predetermined force, the pressure in the carrier plenum associated with the outermost rib; and initiating relative motion between the work piece diaphragm and the polishing pad.

20. The method of claim 19 wherein the step of adjusting comprises the step of adjusting the pressure in the carrier plenum associated with the outermost rib independent of the pressure established in each of the pressure adjustable web plenums.

21. The method of claim 19 further comprising the step of adjusting the pressure in each of the pressure adjustable carrier plenums, the pressure in the carrier plenum associated with the outermost rib being adjusted independently of the pressure in each of the other carrier plenums.

* * * * *